US006739077B2

(12) United States Patent
Morgan

(10) Patent No.: US 6,739,077 B2
(45) Date of Patent: May 25, 2004

(54) SPORTS FOOTWEAR WITH IMPROVED FLEXIBILITY

(75) Inventor: Valentino Morgan, Crocetta del Montello (IT)

(73) Assignee: Tecnica SpA, Treviso (IT)

( * ) Notice: Subject to any disclaimer, the term of this patent is extended or adjusted under 35 U.S.C. 154(b) by 0 days.

(21) Appl. No.: 10/312,212

(22) PCT Filed: Apr. 16, 2002

(86) PCT No.: PCT/EP02/04200

§ 371 (c)(1),
(2), (4) Date: Dec. 23, 2002

(87) PCT Pub. No.: WO02/085149

PCT Pub. Date: Oct. 31, 2002

(65) Prior Publication Data

US 2003/0097766 A1 May 29, 2003

(30) Foreign Application Priority Data

Apr. 23, 2001 (IT) ..... TV2001A0051

(51) Int. Cl.[7] ..... A43B 7/20

(52) U.S. Cl. ..... 36/115; 36/89; 36/117.6; 36/10

(58) Field of Search ..... 36/115, 89, 117.6, 36/10

(56) References Cited

U.S. PATENT DOCUMENTS

| | | | | |
|---|---|---|---|---|
| 4,095,356 A | | 6/1978 | Robran et al. | |
| 4,505,056 A | | 3/1985 | Beneteau | |
| 5,761,830 A | | 6/1998 | Condini | |
| 5,778,566 A | * | 7/1998 | Edauw et al. | 36/117.6 |
| 5,819,441 A | | 10/1998 | Perrissoud | |
| 6,012,726 A | * | 1/2000 | Grande et al. | 36/115 |
| 6,233,848 B1 | * | 5/2001 | Bonaventure | 36/89 |
| 6,374,516 B1 | * | 4/2002 | Bonaventure et al. | 36/115 |

FOREIGN PATENT DOCUMENTS

| | | |
|---|---|---|
| EP | 0 819 390 A | 1/1998 |
| EP | 0 919 265 A2 | 6/1999 |
| EP | 0 947 144 A | 10/1999 |
| EP | 1 157 622 A | 11/2001 |
| WO | WO 92/10955 A | 7/1992 |

* cited by examiner

*Primary Examiner*—Ted Kavanaugh
(74) *Attorney, Agent, or Firm*—Birch, Stewart, Kolasch & Birch, LLP

(57) ABSTRACT

In a sports footwear that comprises also a rigid reinforcement structure (200), a shoe (100) of soft, flexiable material comprises two superimposed sub-assemblies (110, 150). The upper sub-assembly (150) slides, jointly with a leg-portion (120) that is a part of the lower sub-assembly (110), with respect to an upper (111) which is also a part of the said lower sub-assembly. USE: skates with in-line rollers, boots for cross-country skiing, snowboard and the like. Advantages: improved flexibility of the user's ankle. Improved manufacturability.

5 Claims, 6 Drawing Sheets

SPORTS FOOTWEAR WITH IMPROVED FLEXIBILITY

This application is the national phase under 35 U.S.C. §371 of PCT International Application No. PCT/EP02/04200 which has an International filing date of Apr. 16, 2002, which designated the United States of America.

The present invention refers to sports footwear which can for instance be used for skates with in-like rollers, boots for cross-country skiing and snowboarding, as an inner component part of a ski boot, and the like.

DESCRIPTION

The present invention refers to sports footwear which can for instance be used for skates with in-like rollers, boots for cross-country skiing and snowboarding, as an inner component part of a ski boot, and the like.

DESCRIPTION OF THE RELATED ART

In sports practices of this kind, the foot is subject to repeated bendings of the ankle, whereas the heel must remain steadily firm and locked in the proper seat in the footwear. Accordingly, it is a basic pre-requisite of such a kind of footwear to be constructed in such a manner as to both favour a bending of the ankle and spare the user such dangerous mishaps as muscular sprains or even simply undesirable side-effects such as foot movements that appear to be scarcely polished and/or of a scarce effeciency when practicing the sport activity.

U.S. Pat. No. 4,505,056 discloses a sports footwear which is particularly suitable for cross-country skiing applications and is substantially constituted by an outer shell made of a rigid polymeric material and by an inner shoe that is removable from the outer shell and is made of a soft, flexible polymeric material, such as for instance foamed polyurethane. Both the outer shell and the inner shoe comprise, as an integral, single-piece injection-moulded part, a sole and an upper. The upper of the outer shell is provided, further to a transverse fastening clip, with first downward cutouts extending below the ankle in correspondence with the instep, and second cutouts extending as far as the sole at the level of the metatarsus. The upper of the inner shoe in turn comprises: a relatively thin and compact rear portion associated to a padding with another transverse fastening clip, which rises up within the outer shell above the ankle; a relatively thick and compressible front portion that extends within the outer shell to reach the toe of the footwear; an intermediate portion, which is also relatively thick and compressible and covers the top of the foot. In correspondence of said second cutouts of the upper of the outer shell, the upper of the inner shoe is therefore exposed to view and provided with some transverse grooves intended to facilitate the metatarsal bending of the foot.

This footwear is anyway quite complex in its construction, especially as far as the parts of differing thickness of the inner shoe are concerned. Furthermore, it is quite obviously subject to penetration of water and/or snow at the locations where the upper of the same inner shoe is exposed.

It would on the contrary be desirable, and is actually a main purpose of the present invention, to provide a footwear of the above illustrated kind that, further to complying with the afore indicated pre-requisite in the best possible manner, is also capable of being manufactured industrially on a large scale in a simple manner and at low costs.

Another well-known kind of footwear construction comprises a lower shell and a upper shell provided with a rear door, that is hinged according to a transverse axis arranged in the zone of the heel, for the foot to enter the footwear, as well as an insert of elastic material and an associated padding element that are accommodated between the lower shell and the upper shell, in front of the instep—see U.S. Pat. No. 4,095,356. However, such a construction is only partially capable of meeting the afore mentioned pre-requisite, since it not only needs a rigid shell, but also an equally rigid leg-portion to compress the elastic insert to an adequate extent during the controlled forward deflections of the shell. Actually, this is true and needed only in the case of footwear items, i.e. boots for downhill skiing, where structural rigidity of the footwear is a must. It shall further be duly borne in mind that a risk always exists for the insert and/or padding element to be lost, in which case they can actually be going to be replaced with other parts that may be differently sized and/or be made of different material so as to result in different bending characteristics of the footwear.

Similar considerations can also be made in connection with another prior-art footwear construction—as disclosed in U.S. Pat. No. 5,819,441—in which an element of a viscoelastic material adapted to dampen shocks is arranged in the top zone of the footwear, although such an element is actually subject to shear stress rather than compression stress.

BRIEF SUMMARY OF THE INVENTION

A footwear provided with at least one elastically deformable element that is an integral, non-removable part of a flexible shoe, enables not only to meet the above cited pre-requisite, but even to achieve other objects.

Further scope of the applicability of the present invention will become apparent from the detailed description given hereinafter. However, it should be understood that the detailed description and specific examples, while Indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

To the purpose of confirming the above statement and emphasize the actual advantages of the present invention, me description shall now be given of a preferred, although not so embodiment of the invention with reference to the accompanying drawings, which are given by way of illustration only, and thus are not limitative of the present invention, in which.

DETAILED DESCRIPTION OF THE INVENTION

Figure 1:
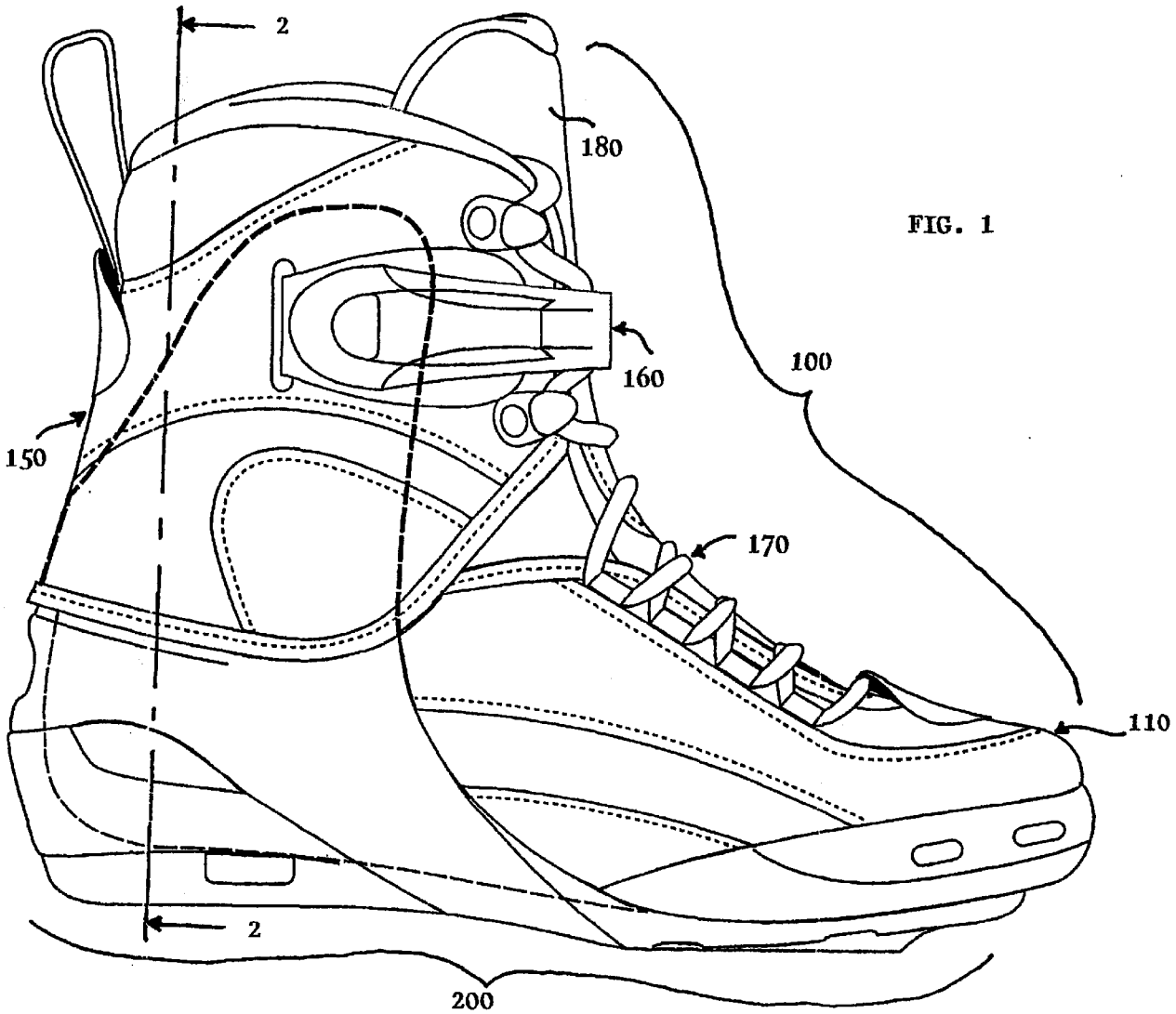
FIG. 1 is a side overall view of a footwear according to the present invention.
Figure 2:
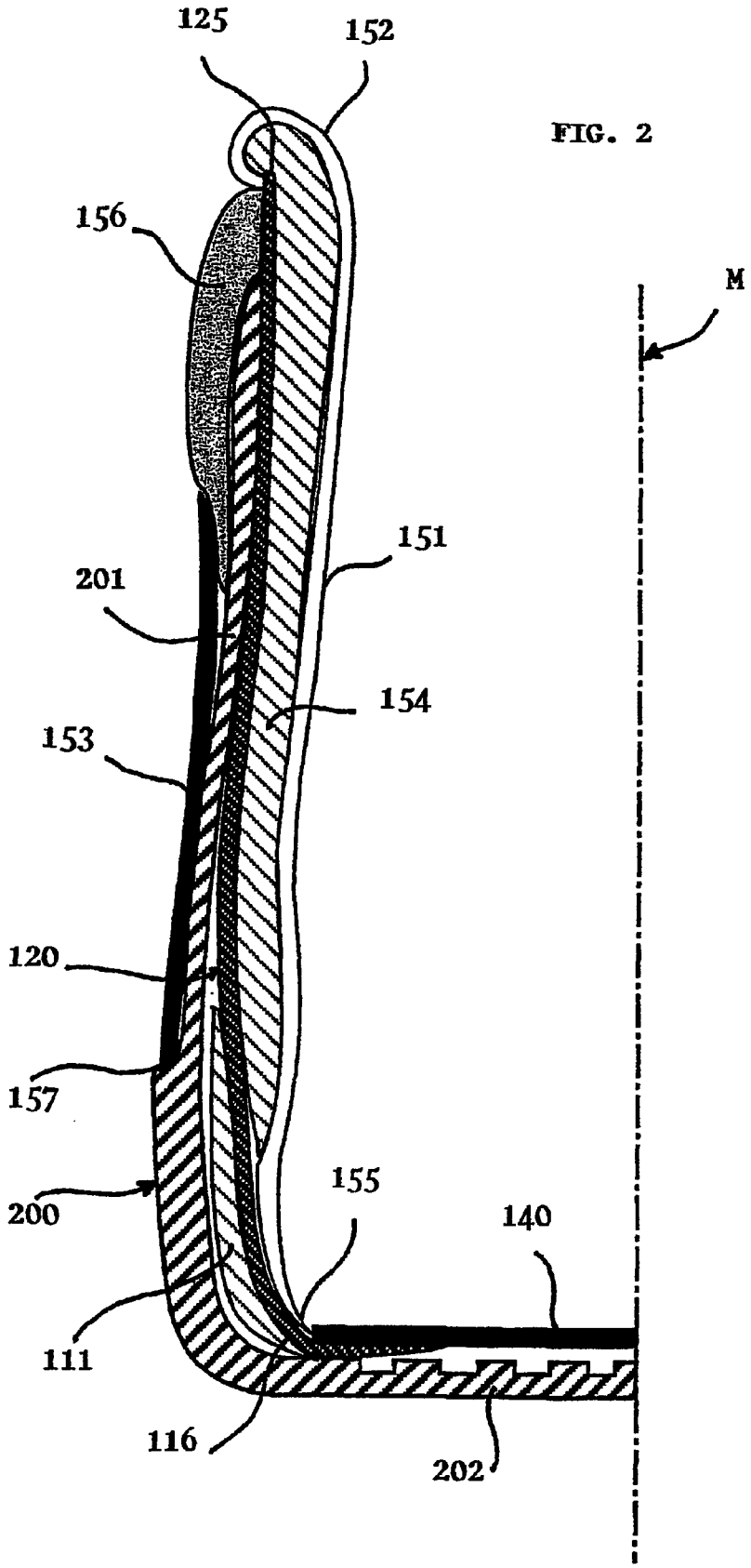
FIG. 2 is a cross-sectional view along the line 2—2 of FIG. 1, which only shows the parts situated on a single side of the longitudinal centre-line plane of the footwear, for reasons' of greater simplicity.
Figure 3:
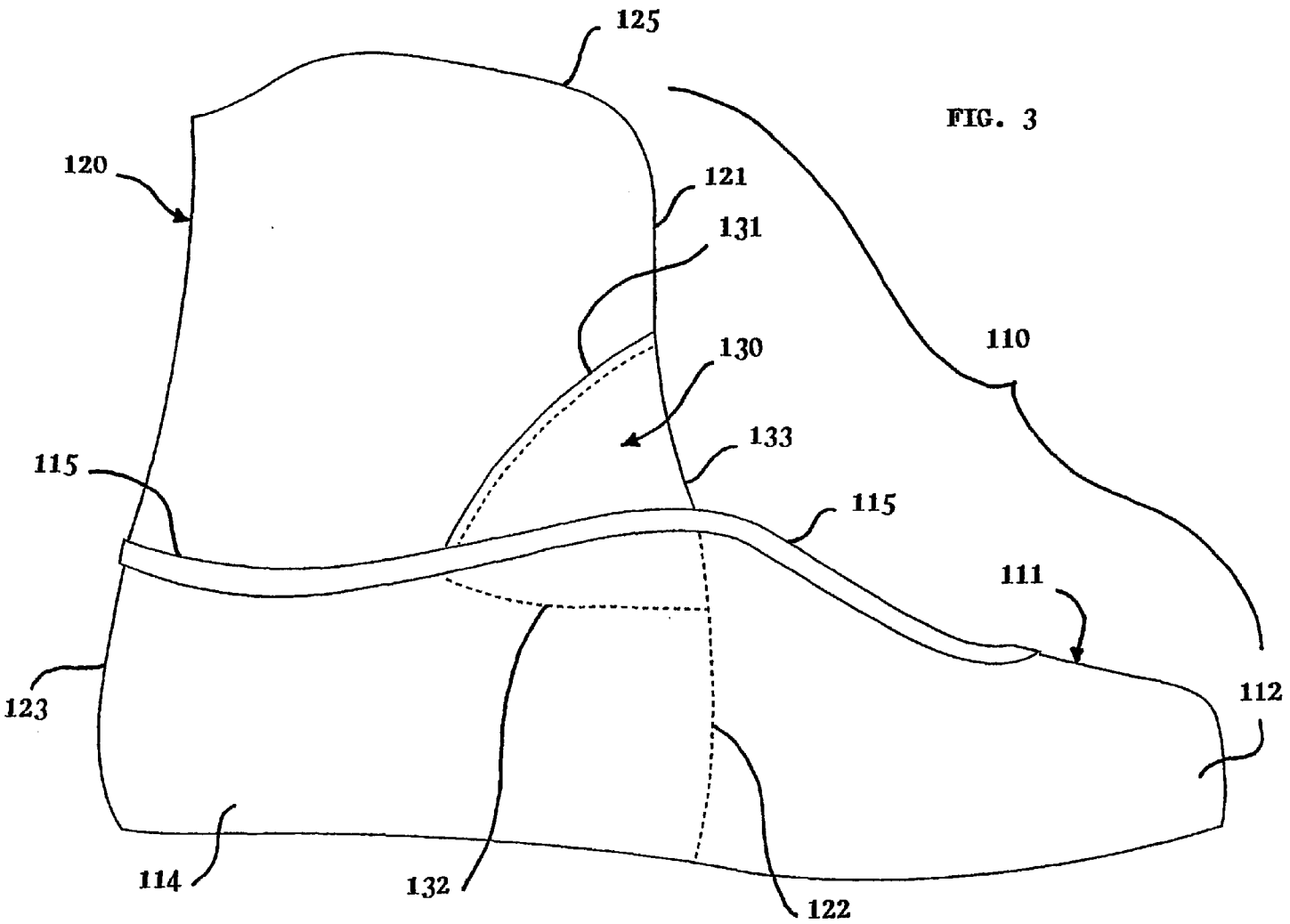
FIGS. 3 and 4 are side views of a first and a second sub-assembly of the footwear, respectively.
Figure 4:
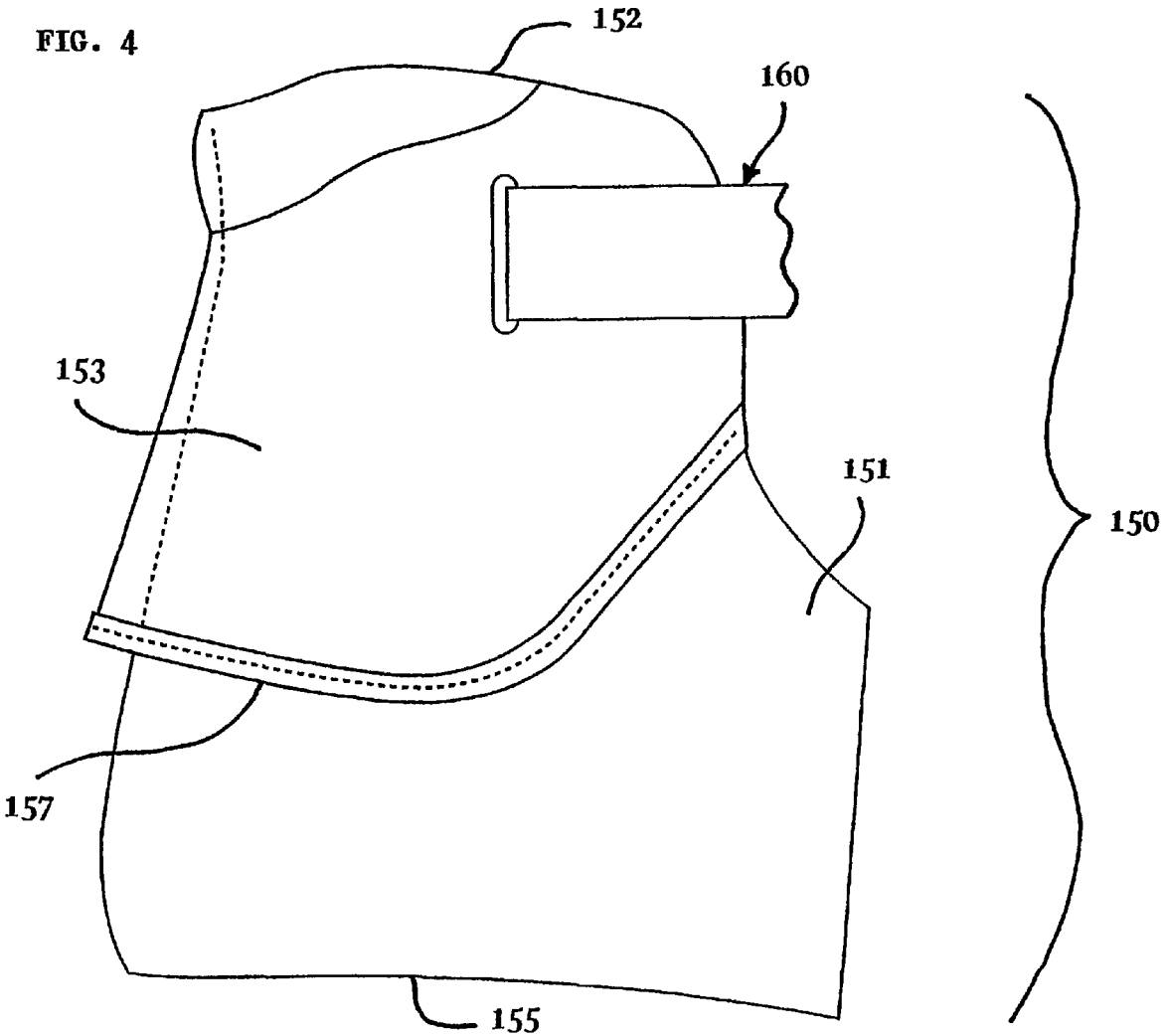

The footwear described here, and illustrated in FIGS. 1 and 2, not only comprises an innovatory shoe 100, made of soft, flexible materials, whose details are better visible especially in FIGS. 3 and 4, but also an associated reinforcing shell 200, of rigid polymeric materials and can be manufactured as described either in patent application EP-A-919 265 or in a new patent application filed jointly with this one by the same Applicant. However, especially in view of particular applications, such as snowboarding, the present invention may be fitted with reinforcement elements of a different kind as well.

The shoe 100 is constituted by two sub-assemblies 110 and 150, which are also referred to as lower part and upper part, respectively, in the following description in connection with the fact that one of these parts is so-to-say placed upon the other one during the manufacturing process of the footwear, as this shall be explained in greater detail further on.

The lower part 110 comprises an upper 111, which is made in a conventional manner using a fabric of a synthetic material backed by a felt, with a toe portion 112, an intermediate portion 113, a heel portion 114 and a leg-portion 120, preferably made using a felt—see FIG. 3.

The toe portion 112 of the upper 111 is closed on top, whereas the other two portions 113 and 114 of the upper are open on top, below the ankle of the user, and show an edge 115 that has a curved contour with a downwards facing concavity in correspondence of said leg-portion 120.

The leg-portion 120 has following characteristics:

- it extends upwards so that the upper edge 125 thereof lies above the ankle, at a level that may also be differentiated in accordance with the kind of sporting practice which the footwear is actually intended for;
- it extends downwards into the upper 111 so as to practically reach down to the lower edge 116 of the upper 111, upon passing through the afore mentioned open upper edge 115, in view of being joined in a conventional manner, along with the same upper, to an insole 140—see FIG. 2;
- it is open frontally so as to show an edge whose zone extending above the upper 111, as generally indicated at 121 in FIG. 3, follows the curvature of the instep of the foot, whereas the zone thereof extending inside the said upper, as generally indicated at 122, is rather approximately vertical. Said inside zone 122 of the said edge lies in correspondence of the intermediate portion 113 of the upper 111, i.e. in a rearward position with respect to the metatarsus, but ahead of the ankle of the user;
- it is sewn to the heel portion 114 along the line 123 following the profile of the heel, to the intermediate portion 113 of the upper 111 along at least a zone of the afore mentioned open edge 115, as well as along the lower edge 116—see also FIG. 2;
- it is separated from the inner surface of the upper 111 along the whole length 122;
- it is sewn (preferably on both the inner side and the outer side of the shoe with respect to the longitudinal centre-line plane M, as indicated in FIG. 2) to a couple of flat reinforcing elements, or facings, only one of which, i.e. the one indicated at 130, is illustrated in the accompanying Figures and described below. The facing 130 (which is preferably made in the same manner as upper 111, i.e. using a fabric of a synthetic material backed by a felt) is of a substantially triangular shape when seen from a side thereof as in FIG. 3. The sewing seams of the facing 130 to the leg-portion 120, which coincide with two sides of the border thereof and cross each other approximately at the level of the open edge 115 of the upper 111, are indicated at 131, 132. The third side 133 of the border of the facing 130 coincides with a part of the zones 121, 122 of the front open edge of the leg-portion 120, so that it is separated from the inner surface of the upper 111, too.

The upper part 150, which forms the second sub-assembly of the boot 100, comprises in turn—as illustrated in FIG. 2—an inner lining 151 having the top edge 152 so folded as to be able to wrap up and retain at least a part of a padding 154 (see FIG. 2), and furthermore an outside pocket 153 that remains joined to the lining 151—for instance by means of a sewing seam, which is not shown in the accompanying Figures for reasons of greater simplicity—only in correspondence of a zone of the edge 152. The lower edge 157 of said pocket 153 is in fact separated from the inner lining 151, as this can be best seen in FIG. 2. Both the inner lining 151 and the outside pocket 153 are made for instance of a fabric of synthetic material.

The assembly of the above described footwear requires the upper part 150 to be inserted into the lower part 110 in the manner shown in FIG. 2, i.e. in such a manner as:

- to enable the inner lining 151 to be joined along the lower edge 155 thereof to the insole 140, as well as to the lower edge 116 of the upper 111 and to the leg-portion 120;
- to ensure that the surface of the leg-portion 120 which is facing the longitudinal centre-line plane M, lies in contact with the outer surface of the padding 154 within the pocket 153;
- to enable the folded upper edge 152 of the lining 151 to be also joined, for instance by sewing, to the upper edge 125 of the leg-portion 120;
- to ensure that the upper 111, according to an essential feature of the present invention, has no point of contact (except for the portion thereof in correspondence of the insole 140, as explained earlier in this description) with the upper part 150 of the shoe 100 owing to the presence, on the sides of the footwear, of the leg-portion 120 and the facings 130 in an intermediate position between the open edge 115 of the upper 111 and the free lower edge 155 of the inner lining 151.

The portion 201 that extends upwards and, jointly with the outsole 202 is a portion of the rigid shell 200, is advantageously inserted into the pocket 153 in such a way as to come into contact with the surface of the leg-portion 120 of the shoe 100 lying on the opposite side with respect to the longitudinal centre-line plane M. A conventional padded collar 156, or cuff, is additionally applied on the outside of said leg-portion 201, substantially above the pocket 153.

In a per se known manner, the footwear comprises a fastening strap 160 attached to the outer surface of the pocket 153 for closing the leg-portion 120 and the facings 130 (see FIGS. 1 and 4) as well as a lace 170 (shown in FIG. 1 only) for closing the upper 111 in combination with an also per se known tongue 180 (see FIGS. 1, 5 and 6) extending from the toe portion 112 up to a level that is not lower than the level of the folded upper edge 152 of the lining 151.

Figure 5:
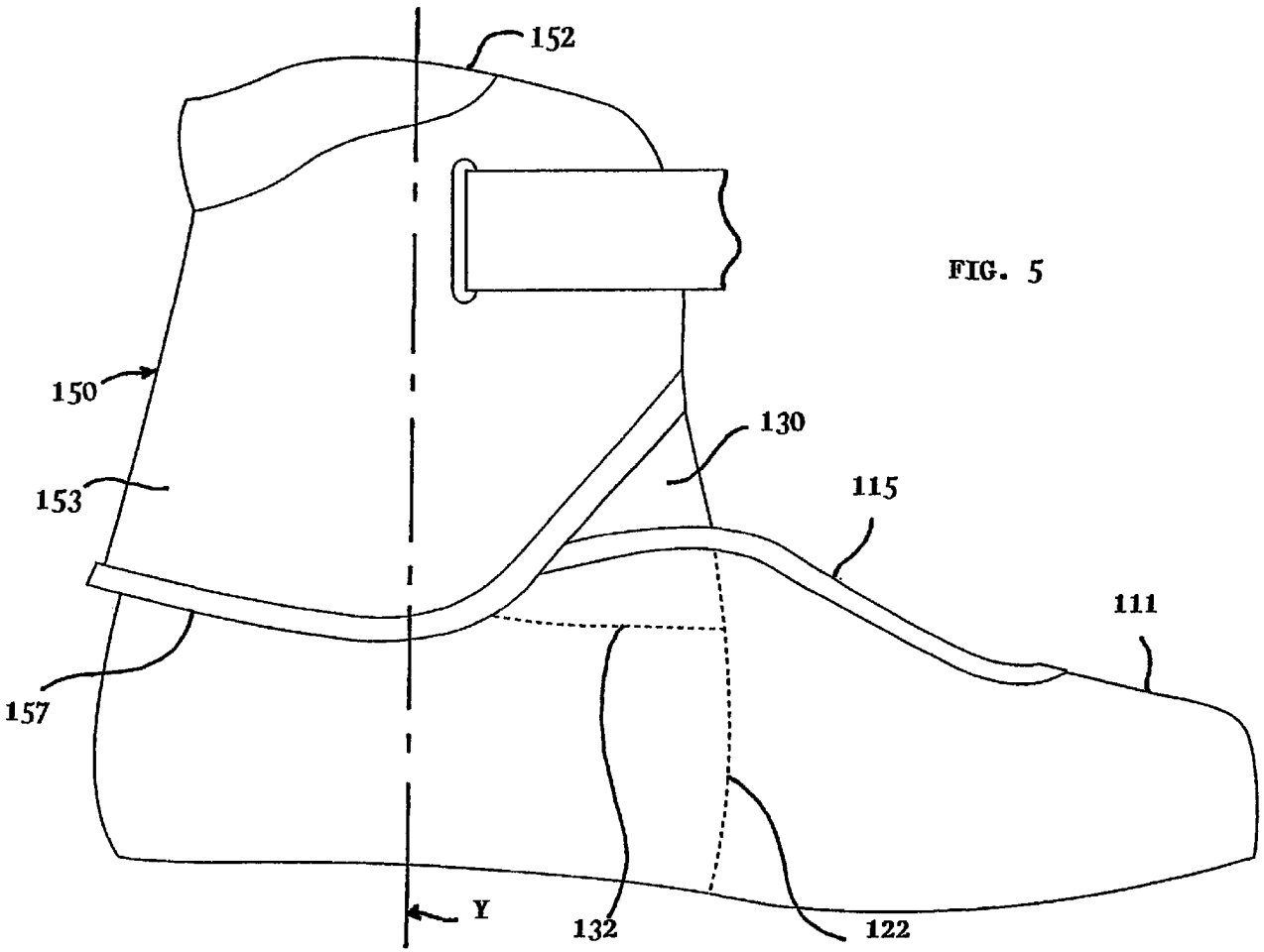
FIGS. 5 an 6 are side views of the said sub-assemblies upon having been joined with each other, when the foot (not shown) of the user is at rest and when the ankle is bending, respectively.
Figure 6:
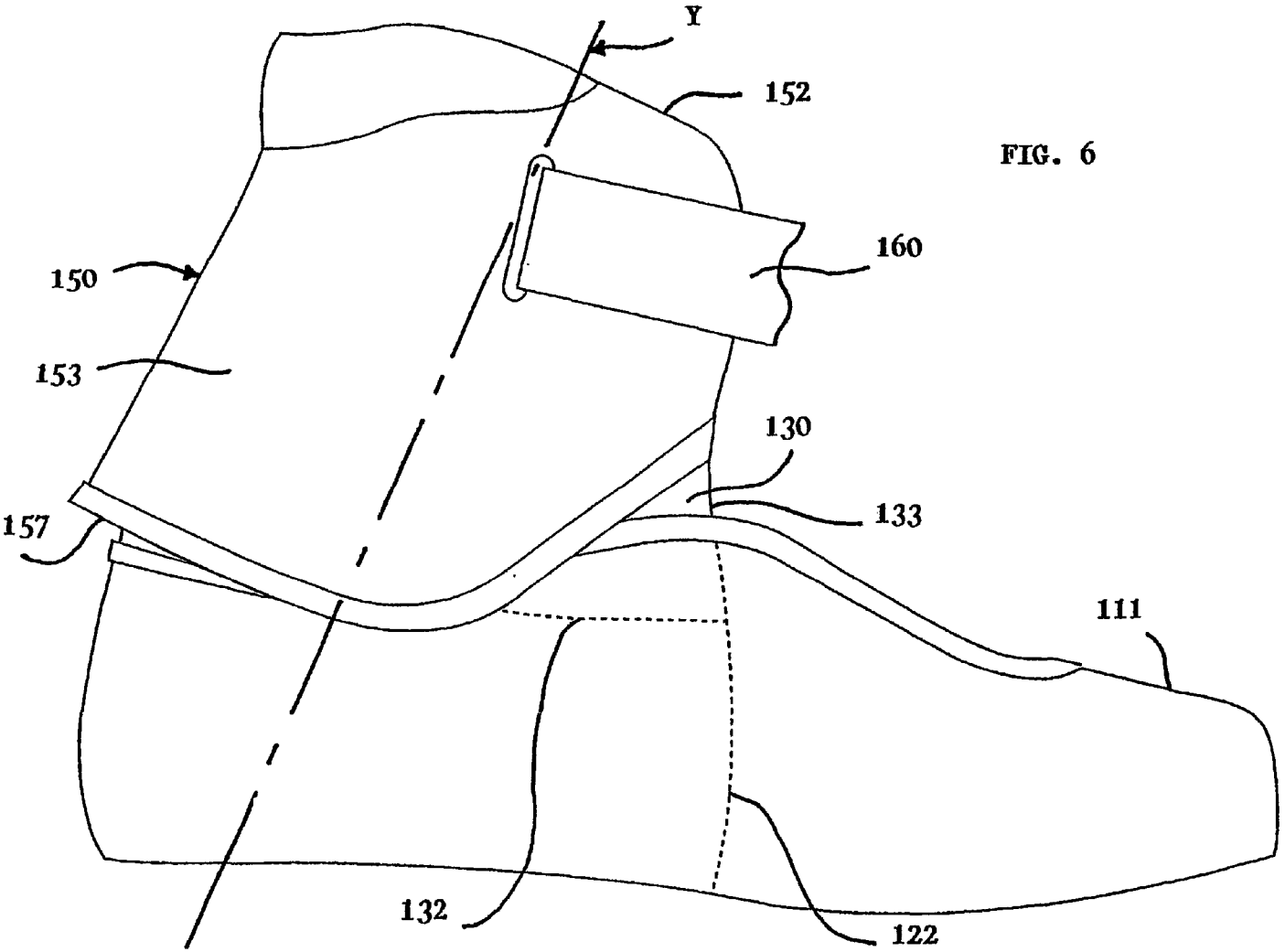

The peculiar functionality of a footwear according to the present invention, deriving essentially from the fact that the upper 111 has no point of contact (except than in correspondence of the insole 140) either with the inner lining 151 or the padding 154 or even the pocket 153 of the upper part 150, can be best inferred by comparing the illustrations in FIGS. 5 and 6.

Under rest conditions, the imaginary central axis Y of the leg-portion 120, which is part of the shoe 100, is vertical, whereas the lower edge 157 of the pocket 153, which has already been told to be separated from both the upper 111 and the leg-portion 120, is on the contrary in contact, at its forward facing end, with the outer surface of the facings 130—see FIG. 5.

During the use of the footwear, when the ankle is inflected, said axis Y of the leg-portion 120 is inclined forwards as the zone 122 of its front open edge slides forwards with respect to the upper 111—see FIG. 6. Also the facings 130 are subject to the same sliding motion, owing to the sewing seams 131, 132 joining them to the leg-portion 120 and the fact that also the front side 133 of the border thereof is separated from the upper.

The inherent advantages of the present invention can be summarized as follows:

- the ankle is enabled to bend without encountering any hindrance, with the slightest effort on the part of the user;
- the sliding motion of the leg-portion 120 jointly with the upper part 150 of the shoe 100 with respect to the upper 111 is not accompanied by any temporary formation of wrinkles of the upper, which would prove a real nuisance to the user;
- no additional parts of the footwear, such as inserts made of an elastic material, paddings or buffers which, in order to be installed, require phases to be performed that are discontinuous with respect to a smothed assembly cycle. In other words, the sewing of such facings as those indicated at 130 to the leg-portion 120 is perfectly integrated into the manufacturing cycle of the shoe 100 and, therefore, is an operation that can be carried out most easily and at minimum costs also in case of large-scale industrial manufacturing operations;
- the presence of the facings 130, further to reinforcing the leg-portion 120, does not affect the tightness of the shoe 100 against possible infiltrations of water and/or snow into the upper 111;
- joining the shoe 100 with the reinforcement structure 22 is made easy by the provision of the downwards opening pockets 153. The outstanding portions 201 of the structure 200 can therefore be conveniently inserted thereinto using simple tools and at a low cost.

Although the above description refers to a preferred embodiment of the present invention, it will be readily appreciated that those skilled in the art may be capable of developing the above described footwear in a number of different manners without departing from the scope of the present invention as defined by the appended claims. In particular, the footwear may be also implemented without making any use of the afore cited facings, as well as with use of a rigid reinforcement structure differing from the one mentioned in the above description.

What is claimed is:

1. Sports footwear comprising a reinforcement structure made of rigid materials and firmly joined to a shoe made of soft, flexible materials that comprises a first sub-assembly including:

- an upper open on top, except at a toe portion thereof, along an edge lying below an ankle of a user,
- a leg-portion open frontally and extending upwards to such an extent that its top edge lies above the ankle of the user, and downwards into the upper,
- an insole joined to a lower edge of at least one of the upper a lower edge of the leg-portion,
- and a second sub-assembly including:
  - an inner lining, whose lower edge is also joined to the insole, and whose upper edge is joined to the top edge of the leg-portion,
  - at least a padding layer provided between the leg-portion and the inner lining,
  - an outer lining extending from the top edge of the leg-portion so as to at least partially cover the padding layer
  - wherein the upper, to the purpose of enabling the leg-portion to slide jointly with the second sub-assembly when the ankle is bending, is separated from said second sub-assembly, except for a zone of the insole, and furthermore, in said first sub-assembly, seams being provided along which the leg-portion is joined to the upper differ from a zone of an open front edge of the leg-portion that lies within the upper itself.

2. The sports footwear according to claim 1, wherein the leg-portion is joined, on at least a side with respect to the longitudinal centre-line plane, to a flat reinforcing element which is extended from the front open edge thereof.

3. The sports footwear according to claim 2, wherein the seams along which the flat reinforcement element is joined to the leg-portion do cross each other approximately at the level of the upper open edge of the upper.

4. The sports footwear according to any of the preceding claims, wherein the lower edge of the outer lining is separated from the inner lining and the leg-portion so as to provide a pocket adapted to accommodate an upwards extending portion of the rigid reinforcing structure.

5. The sports footwear according to claim 1, wherein the boot comprises on the front a tongue means for tightening the upper and the leg-portion.

* * * * *